United States Patent [19]

Guglielmetti

[11] Patent Number: 5,001,253

[45] Date of Patent: Mar. 19, 1991

[54] FLUORESCENT BRIGHTENERS CONSISTING OF BIS-STYRYLBENZENE COMPOUNDS, A PROCESS FOR THEIR PREPARATION AND THEIR USE

[75] Inventor: Leonardo Guglielmetti, Bottmingen, Switzerland

[73] Assignee: Ciba-Geigy Corporation, Ardsley, N.Y.

[21] Appl. No.: 520,843

[22] Filed: May 10, 1990

Related U.S. Application Data

[60] Continuation of Ser. No. 234,192, Aug. 19, 1988, abandoned, which is a division of Ser. No. 756,382, Jul. 18, 1985, Pat. No. 4,778,623, which is a division of Ser. No. 474,731, Mar. 18, 1983, Pat. No. 4,785,128, which is a continuation of Ser. No. 213,150, Dec. 4, 1980, abandoned.

[30] Foreign Application Priority Data

Dec. 13, 1979 [CH] Switzerland ..... 11040/79
Apr. 21, 1980 [CH] Switzerland ..... 3058/80

[51] Int. Cl.[5] ..... C07C 255/00

[52] U.S. Cl. ..... 558/415; 558/399; 549/475; 560/51; 252/301.22

[58] Field of Search ..... 558/415, 373, 399; 560/51; 252/301.22, 301.23, 301.24; 549/475

[56] References Cited

U.S. PATENT DOCUMENTS

| | | | |
|---|---|---|---|
| 3,271,321 | 9/1966 | Stilz et al. | 558/415 |
| 3,689,481 | 9/1972 | Scheuermann et al. | 558/415 |
| 4,093,645 | 6/1978 | Davidson et al. | 252/301.21 |
| 4,104,468 | 8/1978 | Valenti | 252/301.24 |
| 4,154,951 | 5/1979 | Pintschovius | 558/415 |
| 4,216,105 | 8/1980 | Davidson et al. | 252/301.21 |
| 4,330,427 | 5/1982 | Martin et al. | 252/301.24 |
| 4,336,155 | 6/1982 | Martin et al. | 252/301.21 |

FOREIGN PATENT DOCUMENTS

| | | |
|---|---|---|
| 0023027 | 1/1981 | European Pat. Off. . |
| 0032254 | 7/1981 | European Pat. Off. . |
| 1045443 | 10/1966 | United Kingdom . |

*Primary Examiner*—John F. Niebling
*Assistant Examiner*—Steven P. Marquis
*Attorney, Agent, or Firm*—Wenderoth, Lind & Ponack

[57] ABSTRACT

A fluorescent brightener is proposed which consists of 51–99% of an unsymmetrically substituted compound of the formula (1)

in which R and $R_1$ are identical or different and, if R and $R_1$ are identical, $R_1$ must occupy a position in the phenyl ring to which it is bonded which differs from the position occupied by R in its phenyl ring, and in which R and $R_1$ independently of one another are CN or a corboxylic acid ester group, and 49–1% of a symmetrically substituted compound of the formula (2)

in which R is as defined above and the two R's are bonded to identical positions in their phenyl rings, as are also agents which contain these fluorescent brighteners and the use of these fluorescent brighteners for the fluorescent brightening of, in particular, textile materials, preferably made of polyester. The said fluorescent brighteners are prepared by reacting terephthaladehyde preferably with a correspondingly substituted benzylphosphonate and further reacting the resulting mixture of a correspondingly substituted 4-stilbene aldehyde and a symmetrical p-bis-styrylbenzene with a benzylphosphonate which differs from the benzylphosphonate first used.

1 Claim, No Drawings

FLUORESCENT BRIGHTENERS CONSISTING OF BIS-STYRYLBENZENE COMPOUNDS, A PROCESS FOR THEIR PREPARATION AND THEIR USE

This application is a continuation of now abandoned application Ser. No. 234,192, filed Aug. 19, 1988, which application is a division of application Ser. No. 756,382, filed July 18, 1985 (now U.S. Pat. No. 4,778,623), which application is a division of application Ser. No. 474,731, filed Mar. 18, 1983 (now U.S. Pat. No. 4,785,128), which application is, in turn, a continuation of now abandoned application Ser. No. 213,150, filed Dec. 4, 1980.

The present invention relates to fluorescent brighteners consisting of two bis-styrylbenzene compounds, a process for their preparation and novel intermediates obtained in this process, agents containing fluorescent brighteners of this type and the use of these fluorescent brighteners and of the agents containing them for the fluorescent brightening of organic high molecular weight materials.

A large number of bis-styrylbenzene compounds and their use as fluorescent brighteners for diverse substrates has been disclosed in the literature. In this context see Swiss Patent Specifications Nos. 366,512, 382,709, 388,294, 388,929, 389,585, 411,329, 416,078 and 465,548. Some of the individual components which are contained in the fluorescent brighteners of the composition according to the invention have been disclosed in the said publications, for example 1,4-bis-(2-, 3- or 4-cyanostyryl)-benzene or 1,4-bis-(4-methoxycarbonylstyryl)-benzene. Some of these compounds are also available commercially. Furthermore, mixtures of 1,4-bis-styrylbenzene compounds have been disclosed which consist of three components, that is to say of about 50% of an asymmetrically substituted bis-styrylbenzene compound and about 25% of each of two different symmetrically substituted bis-styrylbenzene compounds. Such mixtures are formed purely statistically when one mol of terephthalaldehyde is reacted with a mixture of one mol of each of two substituted or unsubstituted benzylphosphonates.

Mixtures of two or more symmetrically substituted bis-styrylbenzenes have also been disclosed which can be obtained by simple mixing of pure symmetrical compounds.

The use of the mixtures just described as fluorescent brighteners for diverse organic substrates, in particular of polyester, has also been disclosed. In this context see Swiss Patent Specifications Nos. 366,512, 382,709, 416,078 and 465,548.

Further mixtures of three bis-styrylbenzene compounds have been disclosed in Swiss Patent Specifications Nos. 366,512 and 382,709. Such mixtures are obtained by the simultaneous reaction of terephthalaldehyde with a mixture of 50–98 and especially 80–87% of a substituted benzylphosphonate and 50–2, and especially 20–3, % of a substituted benzylphosphonate which differs from the first substituted benzylphosphonate.

However, due to the process of preparation, these known three-component mixtures which have been mentioned can contain at most about 50% of the particular asymmetrically substituted bis-styrylbenzene compound.

It has now been found, surprisingly, that a fluorescent brightener consisting of 51–99%, preferably 80–99% and in particular 90–99% of an asymmetrically substituted 1,4-bis-styrylbenzene compound and 49–1%, preferably 20–1% and in particular 10–1% of a symmetrically substituted 1,4-bis-styrylbenzene compound is capable of producing considerably better white effects than the known corresponding individual compounds and the abovementioned mixtures.

Moreover, the fluorescent brightener of this composition can be prepared very well by the novel process according to the invention.

The fluorescent brightener according to the invention consists of 51–99% of an unsymmetrically substituted compound of the formula

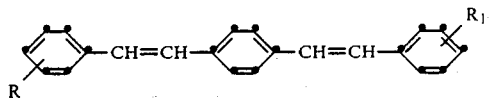

(1)

in which R and $R_1$ are identical or different and, if R and $R_1$ are identical, $R_1$ must occupy a position in the phenyl ring to which it is bonded which differs from the position occupied by R in its phenyl ring, and in which R and $R_1$ independently of one another are CN or a carboxylic acid ester group, and 49–1% of a symmetrically substituted compound of the formula

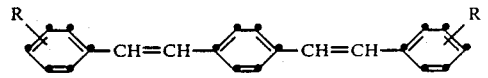

(2)

in which R is as defined above and the two R's are bonded to identical positions in their phenyl rings.

Thus, in every case the bis-styrylbenzene compound (1) must be unsymmetrically substituted. Preferably, the substituents R and $R_1$, irrespective of whether they are identical or different, are bonded to different positions of the particular phenyl rings. Compound (2) is symmetrical both in respect of the substituent R and in respect of its position.

Preferred carboxylic acid ester groups are those of the formula —COOY, in which Y is alkyl having 1 to 6 carbon atoms, alkenyl having 3 to 6 carbon atoms, cycloalkyl having 5 or 6 carbon atoms, halogenoalkyl, aralkyl, especially phenylalkyl, in particular benzyl, carbalkoxyalkyl, cyanoalkyl, hydroxyalkyl, aminoalkyl, alkylaminoalkyl or dialkylaminoalkyl, and all of the abovementioned combined alkyl groups in each alkyl moiety can have 1 to 6 carbon atoms; or Y is propargyl, tetrahydrofurfuryl or a group of the formula $$(CH_2-\underset{\underset{X}{|}}{CH}-O)_n\text{-alkyl},$$

and in the last-mentioned group X is hydrogen or methyl and n is an integer between 1 and 4 and the alkyl group has 1 to 6 carbon atoms. Halogen is to be understood as meaning chlorine, bromine and fluorine, especially chlorine or bromine. The halogenoalkyl and hydroxyalkyl substituents can contain one or more halogen atoms or one or more hydroxyl groups.

Particularly preferentially, Y is alkyl having 1 to 6, and especially 1 to 4, carbon atoms, alkenyl having 3 to 6 carbon atoms and benzyl, in particular alkyl having 1 to 4 carbon atoms. All of the alkyl groups which belong to combined groups (which form the substituent Y) preferably have 1 to 4 carbon atoms.

Fluorescent brighteners according to the invention in which R and $R_1$ in the individual components are identical and are each CN have particularly good properties.

Fluorescent brighteners of particular interest in practice are the two fluorescent brighteners consisting of 51–99% of the compound of the formula

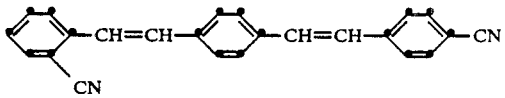

(3)

and 49–1% of the compound of the formula

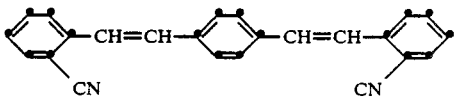

(4)

and of 51–99% of the compound of the formula

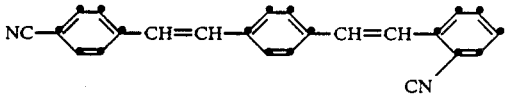

(3)

and 49–1% of the compound of the formula

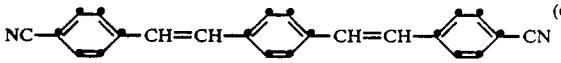

(6)

The fluorescent brighteners according to the invention have particularly valuable properties when they consist of 70–99, especially 80–99 but in particular 90–99% of the unsymmetrically substituted compound, for example of the formula (1) or (3), and 30–1, especially 20–1 but in particular 10–1% of the symmetrically substituted compound, for example of the formula (2), (4) or (6).

Particularly preferred compounds are, therefore, the fluorescent brightener consisting of 90–99% of the compound of the formula (3) and 10–1% of the compound of the formula (4) and the fluorescent brightener consisting of 90–99% of the compound of the formula (3) and 10–1% of the compound of the formula (6).

All of the percentages in this application are by weight, unless indicated otherwise.

The fluorescent brighteners according to the invention are prepared by a novel process, which is likewise a subject of the invention.

When discussing the known bis-styrylbenzenes and the known mixtures thereof, the processes which result in such mixture (statistical mixtures of 3 components) have also already been discussed. Furthermore, German Offenlegungsschrift No. 2,647,179 has disclosed how 2'-cyanostilbene-4-aldehyde, which occurs as an intermediate in the process according to the invention, can be obtained in the pure form with the aid of a multistage synthesis. See page 25, final paragraph to page 27, first paragraph of this publication: preparation of starting compound (3).

It has been found, surprisingly, that the fluorescent brighteners according to the invention can be prepared from two individual components by a very simple synthesis process.

The process according to the invention comprises reacting terephthalaldehyde with a compound of the formula

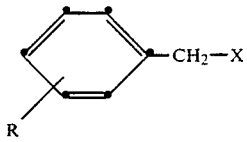

(7)

to give a mixture of the compounds of the formulae

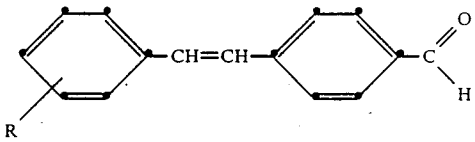

(8)

and

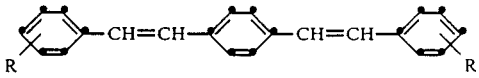

(2)

and then further reacting this mixture with a compound of the formula

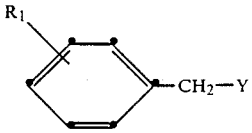

(9)

to give the fluorescent brightener consisting of the compounds (1) and (2), wherein R and $R_1$ are as defined in formulae (1) and (2) and have to satisfy the conditions given under these formulae with regard to their positions in the phenyl rings, and X and Y are identical or different and independently of one another are hydrogen or a radical of the formula —COOZ, in which Z is alkyl; or are radicals of the formulae —ZnBr,

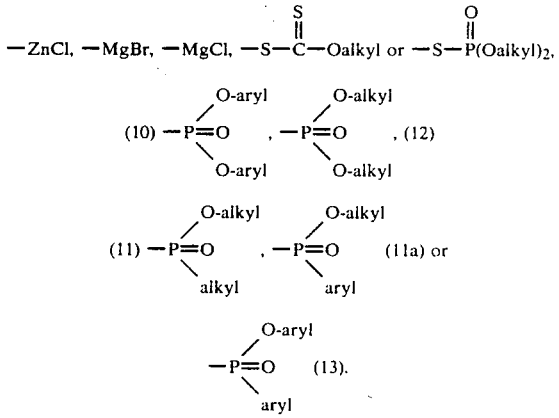

The ratio of terephthalaldehyde to the compound of the formula (7) is dependent on the ratio of unsymmetrically and symmetrically substituted bis-styrylbenzenes which is desired in the final mixture. Accordingly, the ratio of the monoaldehyde (8) to the compound of the formula (9) which reacts therewith can be adjusted to a suitable value. In this way, it is possible, by the choice of the ratios in the starting materials, easily to adjust the ratio. The monoaldehyde (8) content in the reaction mixture can be determined easily by analysis.

Preferably, the reaction is carried out with compounds of the formulae (7) and (9) in which X and Y in each case are a group of the formulae (10) to (13), and in particular a group of the formula (12). In the formulae (10) to (13), alkyl is preferably an unsubstituted alkyl group having 1 to 6 C atoms or the benzyl group, and aryl is preferably phenyl, which is unsubstituted or substituted by chlorine, methyl or methoxy.

A preferred reaction within the scope of the process according to the invention, comprises reacting terephthalaldehyde with a compound of the formula

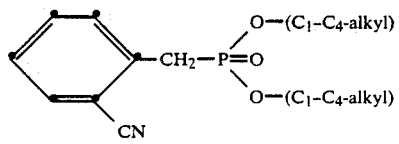

(14)

or

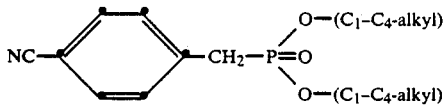

(15)

to give a mixture of the compounds of the formula

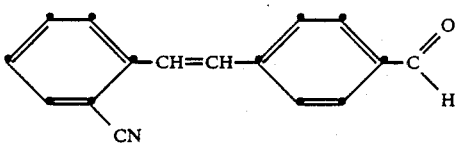

(16)

and of the formula (4) or to give a mixture of the compounds of the formula

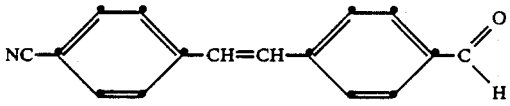

(17)

(17) and of the formula (6) and then reacting the particular mixture obtained with a compound of the formula

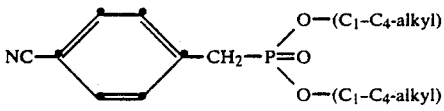

(15)

or

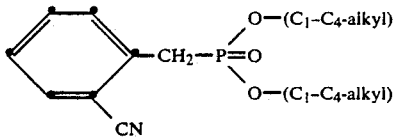

(14)

to give the fluorescent brighteners, according to the invention, consisting of the compounds of the formulae (3) and (4) or (3) and (6).

The reaction of terephthalaldehyde with a compound of the formula (7) in which X is one of the groups (10)–(13) or with a compound of the formula (14) or (15) (first stage) is preferably carried out in the presence of an alkaline condensing agent which serves as a proton acceptor. Suitable condensing agents of this type are inorganic or organic bases, for example hydroxides, hydrides, alkoxides and amides of the alkali metals or alkaline earth metals, monomeric or polymeric strongly basic amines and exchange resins of the OH series. Sodium hydroxide, potassium hydroxide and sodium methylate are of particular importance in practice. A mixture of different bases can also be used. The amount of condensing agent to be used varies within wide limits. Advantageously, the equivalent amount is used, but it is also possible to use an excess. The second stage also (reaction of the mixture of monoaldehyde and symmetrical bis-styrylbenzene compound) is preferably carried out in the presence of the same condensing agent as described for the first stage.

The process according to the invention is advantageously carried out in a solvent which is inert under the reaction conditions. Such solvents are apolar and dipolar aprotic and protic solvents, for example hexane, octane, cyclohexane, toluene, xylene, chlorobenzene and the like; formamide, dimethylformamide, N-methylpyrrolidone, acetonitrile, dimethylsulfoxide and the like; and methanol, ethanol, isopropanol, hexanol and the like. The process according to the invention can also be carried out in water or in water-containing mixtures in the presence or in the absence of phase transfer catalysts.

The first stage is preferably carried out in a solvent in which the monoaldehydes of the formulae (8) or (16) and (17), which are formed, have low solubility, for example in methanol, ethanol, hexane or toluene. During the reaction, the aldehydes formed precipitate out together with the symmetrical compounds of the formulae (2) or (4) and (6) and can be isolated by filtration or, preferably, can be further reacted without isolation. If the resulting mixtures are isolated, they are then preferably employed in the subsequent stage without purification.

The reaction of the monoaldehydes of the formulae (8) or (16) and (17), as mixtures together with the symmetrical compounds of the formulae (2) or (4) and (6), with a compound of the formula (9) or (15) or (14) (second stage) is preferably carried out in a solvent in which the monoaldehydes are partially or completely soluble. Such solvents are aprotic dipolar solvents, for example dimethylformamide, diethylformamide and dimethylsulfoxide.

The reaction temperature varies within wide limits, depending on the solvent chosen, and can be determined easily be preliminary experiments. The first stage is advantageously carried out at temperatures between 0° C. and 50° C., preferably at between 20° C. and 30° C. Suitable temperatures for the second stage are, in particular, temperatures of between 20° C. and 100° C. and preferably of between 30° C. and 50° C.

The compounds of the formulae (7) and (9) which are used as starting materials are known or can be prepared analogously to known processes (cf., for example, German Offenlegungsschrift No. 1,921,466 and British Patent Specifications Nos. 920,988 and 929,436) or in accordance with Example 14 given below (preparation of the starting material).

The invention also relates to the novel compounds of the formulae (17) and (302), which occur as intermediates, specifically 4'-cyanostilbene-4-aldehyde and 3'-cyanostilbene-4-aldehyde, and the ester-aldehydes of the formula

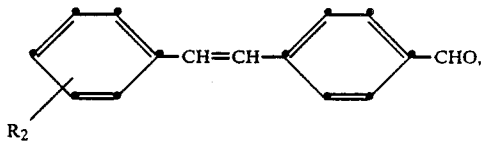

(23)

in which $R_2$ is a carboxylic acid ester group, especially a carboxylic acid ester group of the formula —COOY, in which Y is alkyl, halogenoalkyl, aralkyl, carbalkoxyalkyl, cyanoalkyl, hydroxyalkyl, aminoalkyl, alkylaminoalkyl or dialkylaminoalkyl, and all of the abovementioned alkyl groups and alkyl moieties in composite groups have 1 to 6 carbon atoms in each case; or Y is alkenyl having 3 to 6 carbon atoms, cycloalkyl having 5 to 6 carbon atoms, propargyl, tetrahydrofurfuryl or a group of the formula

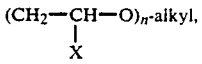

in which X is hydrogen or methyl and n is an integer between 1 and 4 and the alkyl group has 1 to 6 carbon atoms, and to a process for their preparation. This process comprises reacting terephthalaldehyde with a compound of the formula

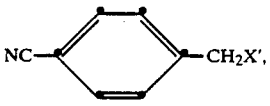

(18)

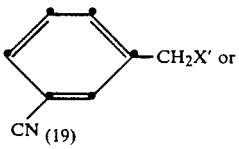

(19)

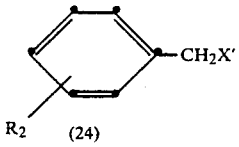

(24)

in which X' is a radical of the formula

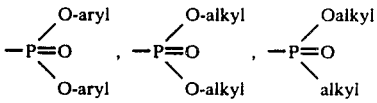

(10) (12) (11)

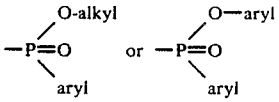

(11a) (13)

and separating off the corresponding aldehyde from the resulting mixture, by recrystallisation, which is repeated several times if necessary, or by chromatography.

Alternatively, it is also possible to react a compound of the formula

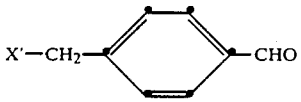

(20)

in which X' is as defined above, with an aldehyde of the formula

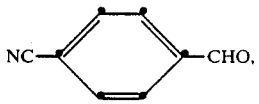

(21)

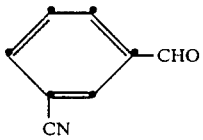

(22)

or

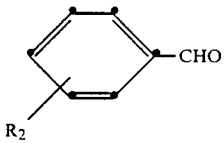

(25)

The process conditions for the reaction of terephthalaldehyde with the compounds of the formulae (18), (19) and (24) correspond to those which have been indicated for the first stage of the process according to the invention for the preparation of the brightener mixtures. The final purification of the aldehydes is advantageously effected by chromatography, for example column chromatography, or preferably by recrystallisation, if necessary by repeated recrystallisation, if necessary with the addition of active charcoal or bleaching earth. Dioxane is the preferred solvent for the recrystallisation.

Preferred novel ester-aldehydes of the formula (23) are those in which $R_2$ is a group of the formula —$COOY_1$, in which $Y_1$ is alkyl having 1 to 4 carbon atoms.

The fluorescent brighteners according to the invention are used for the fluorescent brightening of a wide variety of synthetic, regenerated man-made or natural organic materials.

Without any restriction being implied by the following classification, examples of organic materials which can undergo fluorescent brightening are:

I. Synthetic organic materials of high molecular weight:

(a) Polymerisation products based on organic compounds containing at least one polymerisable carbon-carbon double bond, i.e. their homopolymers or copolymers as well as their after-treatment products, for example crosslinking, grafting or degradation products, polymer blends, or products obtained by modification of reactive groups, for example polymers based on $\alpha,\beta$-unsaturated carboxylic acids or derivatives of such carboxylic acids, especially on acrylic compounds (for example acrylates, acrylic acid, acrylonitrile, acrylamides and their derivatives or their methacrylic analogues), on olefin hydrocarbons (for example ethylene, propylene, styrenes or dienes and also ABS polymers) and polymers based on vinyl and vinylidene compounds (for example vinyl chloride, vinyl alcohol and vinylidene chloride), (b) Polymerisation products which can be obtained by ring opening, for example polyamides of the polycaprolactam type, and also polymers which are obtainable either by polyaddition or by polycondensation, such as polyethers or polyacetals, (c) Polycondensation products or precondensates based on bifunctional or polyfunctional compounds with condensable groups, the homocondensation and co-condensation products, and after-treatment products thereof, for example polyesters, in particular saturated polyesters (for example polyesters of ethylene glycol/terephthalic acid) or unsaturated polyesters (for example maleic acid/-dialcohol polycondensates and their crosslinking products with copolymerisable vinyl monomers), unbranched and branched polyesters (also including those based on polyhydric alcohols, for example alkyd resins), polyamides (for example hexamethylenediamine adipate), maleic resins, melamine resins, the precondensates and analogues thereof, polycarbonates and silicones, (d) Polyaddition products, such as polyurethanes (crosslinked and uncrosslinked) and epoxide resins.

II. Regenerated man-made organic materials, for example cellulose esters of varying degrees of esterification (so-called 2½-acetate or triacetate) or cellulose ethers, regenerated cellulose (viscose or cuprammonium cellulose), or their after-treatment products, and casein plastics.

III. Natural organic materials of animal or vegetable origin, for example based on cellulose or proteins, such as cotton, wool, linen, silk, varnish gums, starch and casein.

The organic materials which are to undergo fluorescent brightening can be in the most diverse states of processing (raw materials, semi-finished goods or finished goods). On the other hand, they can be in the form of structures of the most diverse shapes, for example predominantly three-dimensionally expanded structures, such as sheets, profiles, injection mouldings, various machined articles, chips, granules or foams, and also predominantly two-dimensional structures, such as films, foils, lacquers, coverings, impregnations and coatings, or predominantly one-dimensional bodies, such as filaments, fibres, flocks and wires. The said materials can, on the other hand, also be in an unshaped state, in the most diverse homogeneous or inhomogeneous forms of division, as for example in the form of powders, solutions, emulsions, dispersions, latices, pastes or waxes.

Fibre materials can be, for example, in the form of endless filaments (stretched or unstretched), staple fibres, flocks, hanks, textile filaments, yarns, threads, non-wovens, felts, waddings, flocked structures or woven textile or bonded textile fabrics, knitted fabrics and papers, cardboards or paper pulps.

The fluorescent brighteners to be used according to the invention are of importance, in particular, for the treatment of organic textile materials, especially woven textile fabrics. If fibres, which can be in the form of staple fibres or endless filaments or in the form of hanks, woven fabrics, knitted fabrics, non-wovens, flocked substrates or bonded fabrics, are to be subjected to fluorescent brightening according to the invention, this is advantageously effected in an aqueous medium in which the particular compounds are present in a finely divided form (suspensions, so-called microdispersions, or, if desired, solutions). If desired, dispersing agents, stabilisers, wetting agents and further assistants can be added during the treatment.

The compounds can be applied in a neutral, alkaline or acid bath. The treatment is usually carried out at temperatures of about 20° to 140° C., for example at the boiling point of the bath or near it (about 90° C.). Solutions or emulsions in organic solvents can also be used for the finishing, according to the invention, of textile substrates, as is practised in the dyeing industry in so-called solvent dyeing (pad-thermofixation, or exhaust dyeing processes in dyeing machines).

The fluorescent brightening agents of the present invention can further be added to or incorporated in the materials before or during their shaping. Thus, for example, they can be added to the compression moulding composition or injection moulding composition during the production of films, sheets (for example incorporated in polyvinyl chloride in a roll mill at elevated temperature) or mouldings.

If the shaping of man-made synthetic or regenerated man-made organic materials is effected by spinning processes or from spinning solutions/melts, the fluorescent brightening agents can be applied by the following processes:

addition to the starting substances (for example monomers) or intermediates (for example precondensates or prepolymers), i.e. before or during the polymerisation, polycondensation or polyaddition, sprinkling in powder form on polymer chips or granules for spinning solutions/melts, bath dyeing of polymer chips or granules for spinning solutions/melts, metered addition to spinning melts or spinning solutions and application to the spun tow before stretching.

The fluorescent brightening agents of the present invention can, for example, also be employed in the following use forms:

(a) in mixtures with dyestuffs (shading) or pigments (coloured pigments or especially, for example, white pigments), or as an additive to dyebaths, printing pastes, discharge pastes or reserve pastes, or for the after-treatment of dyeings, prints or discharge prints, (b) in mixtures with carriers, wetting agents, plasticisers, swelling agents, antioxidants, light stabilisers, heat stabilisers and chemical bleaching agents (chlorite bleach or bleaching bath additives), (c) in admixture with crosslinking agents or finishing agents (for example starch or synthetic finishes), and in combination with a wide variety of textile finishing processes, especially synthetic resin finishes (for example creaseproof finishes such as "wash-and-wear", "permanent-press" or "non-iron"), as well as flameproof finishes, soft-handle finishes, anti-soiling finishes or antistatic finishes, or antimicrobial finishes, (d) incorporation of the fluorescent brightening agents into polymeric carriers (polymerisation, polycondensation or polyaddition products) in dissolved or dispersed form, for use, for example, in coating agents, impregnating agents or binders (solutions, dispersions and emulsions) for textiles, non-wovens, paper and leather, (e) as additives to a wide variety of industrial products in order to render these more marketable (for example improving the appearance of soaps, detergents and pigments), (f) in spinning bath preparations, i.e. as additives to spinning baths which are used for improving the slip for the further processing of synthetic fibres, or from a special bath prior to stretching the fibre, (g) in agents for the fluorescent brightening of high molecular weight organic materials of the compositions indicated above, which agents can contain conventional formulating additives and/or, if desired, further fluorescent brighteners from other categories of brighteners, (h) as scintillators for various purposes of a photographic nature, for example for electrophotographic reproduction and supersensitising, and (j) depending on the substitution, as laser dyes.

Agents of this type, which contain the fluorescent brighteners according to the invention, are likewise a subject of the invention.

Conventional formulating additives are, for example, very diverse assistants and extenders, for example anhydrous sodium sulfate, sodium sulfate decahydrate, sodium chloride, sodium carbonate, alkali metal phosphates, such as sodium orthophosphate or potassium orthophosphate, sodium pyrophosphate or potassium pyrophosphate and sodium tripolyphosphate or potassium tripolyphosphate, or alkali metal silicates. However, the agents according to the invention also include aqueous formulations, for example also the application solutions with which textile fibres are subjected to fluorescent brightening and which contain the conventional additives.

Within the scope of the agents according to the invention, particularly preferred agents are those which, in addition to a fluorescent brightener according to the invention (for example mixtures of the compounds (1) and (2), (3) and (4) or (3) and (6)) which gives rise to a greenish to bluish shade on the substrate to be treated, additionally also contain a fluorescent brightener which gives rise to a reddish shade on the substrate to be treated.

Such combinations have the advantage that a particularly attractive neutral white shade of high brilliance can be achieved by this means on textile fibres, in particular on polyester fibres.

Highly advantageous agents are, therefore, those which contain a fluorescent brightener consisting of the compounds (3) and (4) or (3) and (6), or of other mixtures of a symmetrical and unsymmetrical component which are constituents of the fluorescent brighteners according to the invention, and, in addition, a fluorescent brightener from the category of the naphthalimides, bis-benzoxazolyl-ethylenes, bis-benzoxazolylthiophens, stilbenylbenzoxazoles, naphthotriazol-2-ylstilbenes (disclosed in German Offenlegungsschriften Nos. 2,539,537 and 2,539,461) or the coumarins, for example the 3-phenyl-7-pyrazolylcoumarins, the 3-pyrazolyl-7-v-triazolylcoumarins or the 3-v-triazolylcoumarins (disclosed in Swiss Patent Specifications Nos. 566,359 and 592,189), and in particular those which contain, as the fluorescent brightener active substance, 5–90% and in particular 30–70% of a fluorescent brightener according to the invention (for example mixtures of the compounds (1) and (2), (3) and (4) or (3) and (6)) which give rise to a greenish to bluish shade on the substrate treated and 95–10%, and in particular 70–30%, of a fluorescent brightener which gives rise to a reddish shade on the substrate treated, the latter brightener preferably being a brightener from the abovementioned categories.

Brighteners from the category of the naphthotriazolyl-stilbenes and of the triazolylcoumarins are particularly suitable in agents according to the invention as fluorescent brighteners which give rise to a reddish shade.

Examples of fluorescent brighteners which give rise to a reddish shade and which can be employed in agents according to the invention are, inter alia: 2,5-bis-(benzoxazol-2-yl)-thiophen, 4-(5-methylbenzoxazol-2-yl)-4'-carbomethoxystilbene, 1-methyl-5-methoxynaphthalimide, 3-phenyl-7-(4-phenyl-5-methyl-v-triazol-2-yl)-coumarin, 3-(4-chloropyrazol-1-yl)-7-(4-phenyl-5-methyl-v-triazol-2-yl)-coumarin and, in particular, 3-(2-phenyl-v-triazol-4-yl)-7-methoxycoumarin and 4-(naphtho[1,2-d]triazol-2-yl)-4'-carbethoxystilbene.

Substrates which are particularly preferentially brightened using the fluorescent brighteners according to the invention are those made of polyester, especially textile materials made of polyester.

If the brightening process is combined with textile treatment or finishing methods, the combined treatment can in many cases advantageously be carried out with the aid of appropriate stable preparations which contain the fluorescent brightener compounds in such a concentration that the desired white effect is achieved.

In certain cases, the fluorescent brighteners are made fully effective by an after-treatment. This can be, for example, a chemical treatment (for example acid treatment), a heat treatment or a combined chemical/heat treatment. Thus, for example, the appropriate procedure to follow in brightening a number of fibre substrates, for example polyester fibres, with the fluorescent brightening agents of the present invention, is to impregnate these fibres with the aqueous dispersions (or, if desired, also solutions) of the fluorescent brightening agents at temperatures below 75° C., for example at room temperature, and to subject them to a dry heat treatment at temperatures above 100° C., it generally being advisable additionally to dry the fibrous material beforehand at a moderately elevated temperature, for example at not less than 60° C. to about 130° C. The heat treatment in the dry state is then advantageously carried out at temperatures between 120° and 225° C., for example by heating in a drying chamber, by ironing within the specified temperature range or by treatment with dry, superheated steam. Drying and the dry heat treatment can also be carried out in immediate succession or combined in a single operation.

The amount of the fluorescent brightening agents to be used according to the invention, based on the material to be subjected to fluorescent brightening, can vary within wide limits. A marked and lasting effect can be obtained even with very small amounts, in certain cases, for example, amounts of 0.001 percent by weight. However, it is also possible to use amounts of up to about 0.8 percent by weight and, if necessary, of up to about 2 percent by weight. For most practical purposes, it is preferable to use amounts of between 0.01 and 0.5 percent by weight.

In the examples which follow parts are by weight, unless indicated otherwise, and percentages are by weight.

EXAMPLE 1

53.6 g of terephthalaldehyde are suspended in 300 ml of absolute ethanol and 144 g of a 30% methanolic solution of sodium methylate are added in the course of 15 minutes at 20° to 25° C., with stirring and under nitrogen. A virtually clear solution forms, and 102 g of the phosphonate of the formula

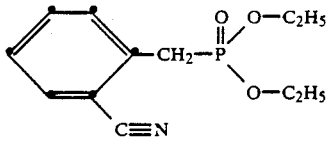

(14)

are added to this solution in the course of 20 minutes at 20° to 25° C., with stirring and under nitrogen, and the reaction product immediately precipitates as crystals. The resulting thick crystalline reaction slurry is now stirred for a further six hours at 20° to 25° C. under nitrogen and is then filtered with suction and the crystalline material is washed with approximately 50 ml of absolute ethanol and dried in vacuo at 50° C. to constant weight. 60.06 g (approximately 64.4% of theory) of a pale yellow crystalline powder with a melting point of 144° to 149° C. are obtained, and this can be identified by analysis by gas chromatography as a mixture consisting of 87.8% of the compound of the formula

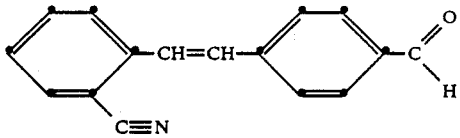

(16)

and 11.3% of the compound of the formula

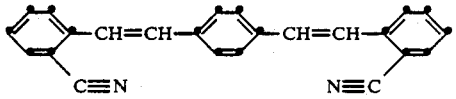

(4)

The phosphonate of the formula (14) which is used as the starting material is prepared analogously to Example 1 of German Offenlegungsschrift No. 1,921,466 and purified by distillation (boiling point$_{0.35}$: 136°-138° C.).

23.3 g of a mixture of compounds (16) and (4), which has been obtained as described above, and 25.3 g of the phosphonate of the formula

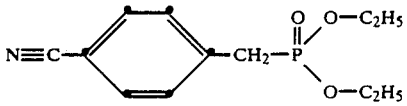

(15)

are suspended in 200 ml of dimethylformamide, and 19.0 g of a 30% methanolic solution of sodium methylate are added in the course of 30 minutes at 30° C., with stirring and under nitrogen, the reaction temperature rising to 40° C. A virtually clear solution first forms and towards the end of the addition of the sodium methylate solution the reaction product precipitates out from this solution as a thick crystalline slurry. The reaction mixture is now stirred for a further four hours at 30° C. under nitrogen and is then diluted at 20° C. with 200 ml of water and neutralised with about 1 ml of glacial acetic acid. The reaction product is filtered off with suction, washed with about 100 ml of dimethylformamide/water (1:1) and then with about 100 ml of methanol and dried in vacuo at 100° C. to constant weight. 28.9 g (approximately 86.9% of theory) of a pale yellow crystalline powder with a melting point of 188° to 233° C. are obtained and on analysis by gas chromatography this proves to be a mixture consisting of 91.2% of the compound of the formula

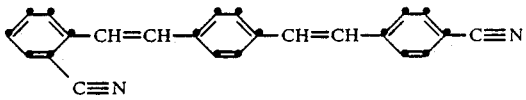

(3)

and 7.7% of the compound of the formula (4).

The phosphonate of the formula (15) which is used as starting material is prepared in accordance with Example 1 of German Offenlegungsschrift No. 1,921,466.

EXAMPLE 2

67 g of terephthalaldehyde are suspended in 300 ml of absolute methanol and 180 g of a 30% methanolic solution of sodium methylate are added in the course of 15 minutes at 20° to 25° C., with stirring and under nitrogen. A virtually clear solution forms, and a solution of 126.6 g of the phosphonate of the formula (15) in 100 ml of absolute methanol is added in the course of 20 minutes at 20° to 25° C., with stirring and under nitrogen, and the reaction product immediately precipitates out as crystals. The resulting crystalline reaction mixture is further treated as described in Example 1. 106.1 g (approximately 91.0% of theory) of a pale yellow crystalline powder with a melting point of 198° to 205° C. are obtained, and on analysis this proves to be a mixture consisting of 92.3% of the compound of the formula

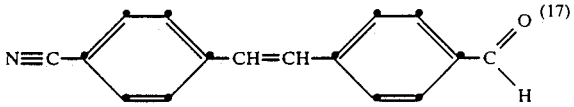

(17)

and 7.1% of the compound of the formula

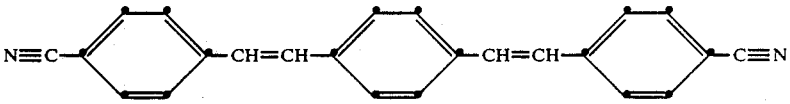

(6)

After recrystallising three times from dioxane, and with the aid of active charcoal, 40.6 g of the aldehyde of the formula (17) are obtained in the form of long pale yellow needles with a melting point of 207° to 210° C.

23.3 g of a mixture of the compounds (17) and (6), which has been obtained as described above, and 25.3 g of the phosphonate of the formula (14) are suspended in 200 ml of dimethylformamide, and 19 g of a 30% methanolic solution of sodium methylate are added in the course of 20 minutes at 30° C., with stirring and under nitrogen, the reaction temperature rising to 40° C. A virtually clear solution first forms and towards the end of the addition of the sodium methylate solution the reaction product precipitates out from this solution in the form of a thick crystalline slurry. The reaction mixture is further treated as described in Example 1. 30.56 g (approximately 91.9% of theory) of a pale yellow crystalline powder with a melting point of 200° to 230° C. are obtained and on analysis this proves to be a mixture consisting of 95.7% of the compound of the formula (3) and 3.2% of the compound of the formula (6).

EXAMPLE 3

26.8 g of terephthalaldehyde are suspended in 100 ml of absolute methanol, and 72 g of a 30% methanolic solution of sodium methylate are added in the course of 15 minutes at 20° to 25° C., with stirring and under nitrogen. A virtually clear solution forms, and a solution of 50.6 g of the phosphonate of the formula

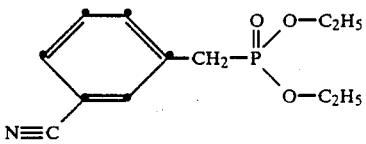

(301)

in 60 ml of absolute methanol is added in the course of 20 minutes at 20° to 25° C., with stirring and under nitrogen, and the reaction product slowly precipitates out as crystals. The resulting crystalline reaction mixture is now stirred for a further 24 hours at 20° to 25° C. under nitrogen, cooled to 0° C. and then filtered with suction, and the crystalline material is washed with about 50 ml of absolute ethanol and dried in vacuo at 50° C. to constant weight. 32.0 g (approximately 68.7% of theory) of a pale yellow crystalline powder with a melting point of 117° to 192° C. are obtained, and on analysis this proves to be a mixture consisting of 81.5% of the compound of the formula

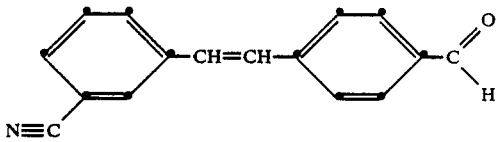

(302)

and 17.2% of the compound of the formula

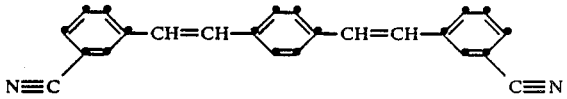

(303)

After recrystallising twice from alcohol, and with the removal of the compound of the formula (303) which is insoluble in alcohol, 14.5 g of the aldehyde of the formula (302) are obtained in the form of pale yellow needles with a melting point of 117° to 119° C.

The phosphonate of the formula (301), which is used as starting material, is prepared in accordance with Example 2 of British Patent Specification No. 920,988.

23.3 g of a mixture of the compounds (302) and (303), which has been obtained as described above, and 25.3 g of the phosphonate of the formula (15) are suspended in 200 ml of dimethylformamide, and 19 g of a 30% methanolic solution of sodium methylate are added in the course of 15 minutes at 30° C., with stirring and under nitrogen. A virtually clear solution first forms and towards the end of the addition of the sodium methylate solution the reaction product precipitates out from this solution in the form of a thick crystalline slurry, the reaction temperature rising to 40° C. The reaction mixture is now stirred for a further four hours at 30° C. under nitrogen and is then diluted at 0° C. with 200 ml of water and neutralised with about 1 ml of glacial acetic acid. The reaction product is filtered off with suction, washed with about 100 ml of dimethylformamide/water (1:1) and then with about 80 ml of ethanol and dried in vacuo at 100° C. to constant weight. 28.55 g (approximately 85.9% of theory) of a pale yellow crystalline powder with a melting point of 199° to 217° C. are obtained, and on analysis this proves to be a mixture consisting of 88.3% of the compound of the formula

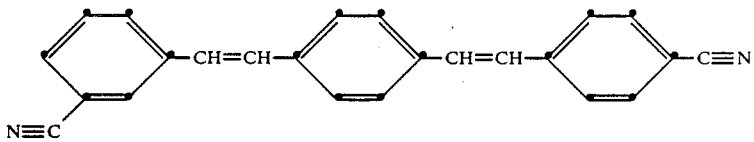

(304)

and 10.9% of the compound of the formula (303).

EXAMPLE 4

23.3 g of the mixture of the compounds (17) and (6), which has been obtained according to Example 2, and 25.3 g of the phosphonate of the formula (301) are reacted as described in Example 3. 29.4 g (approximately 88.5% of theory) of a pale yellow crystalline powder with a melting point of 204° to 220° C. are obtained and on analysis this proves to be a mixture consisting of 95.7% of the compound of the formula (304) and 3.8% of the compound of the formula (6).

EXAMPLE 5

23.3 g of the mixture of the compounds (302) and (303) which has been obtained according to Example 3 and 25.3 g of the phosphonate of the formula (14) are reacted in 100 ml of dimethylformamide as described in Example 3. 23.5 g (approximately 70% of theory) of a pale yellow crystalline powder with a melting point of 174° to 183° C. are obtained, and on analysis this proves to be a mixture consisting of 85.1% of the compound of the formula

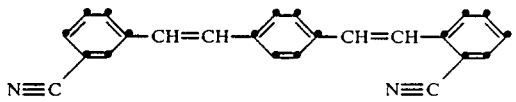

(501)

and 13.8% of the compound of the formula (303).

EXAMPLE 6

23.3 g of the mixture of the compounds (16) and (4), which has been obtained according to Example 1, and 25.3 g of the phosphonate of the formula (301) are reacted in 100 ml of dimethylformamide as described in Example 3. 24.5 g (approximately 73.5% of theory) of a pale yellow crystalline powder with a melting point of 176° to 188° C. are obtained, and on analysis this proves to be a mixture consisting of 91.6% of the compound of the formula (501) and 7.1% of the compound of the formula (4).

EXAMPLE 7

7 g of the mixture of the compounds (16) and (4), which has been obtained according to Example 1, and 7.8 g of the phosphonate of the formula

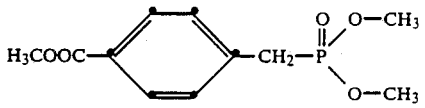

(701)

are reacted in 80 ml of dimethylformamide as described in Example 3. 9.5 g (approximately 87% of theory) of a yellow crystalline product with a melting point of 187° to 205° C. are obtained, and on analysis this proves to be a mixture consisting of 93.3% of the compound of the formula

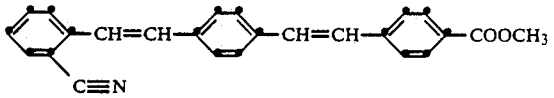

(702)

and 5.6% of the compound of the formula (4).

The phosphonate of the formula (701), which is used as starting material, is prepared in accordance with Example 2 of British Patent Specification No. 929,436.

EXAMPLE 8

9.3 g of the mixture of the compounds (16) and (4), which has been obtained according to Example 1, and

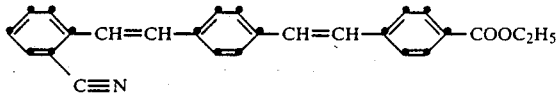

(802)

and 3.9% of the compound of the formula (4).

The phosphonate of the formula (801), which is used as starting material, is prepared analogously to Example 2 of British Patent Specification No. 929,436 and purified by distillation (boiling point$_{0.25}$: 181°-185° C.).

EXAMPLE 9

40 g of terephthalaldehyde are suspended in 100 ml of absolute ethanol, and 300 ml of an ethanolic 2M solution of sodium ethylate are added in the course of 15 minutes at 20° to 25° C., with stirring and under nitrogen. A virtually clear solution forms, and 90 g of the phosphonate of the formula (801) are added in the course of 20 minutes at 20° to 25° C., with stirring and under nitrogen, and the reaction product precipitates immediately as crystals. The resulting thick crystalline reaction slurry is now stirred for a further 16 hours at room temperature under nitrogen and is then filtered with suction, and the crystalline product is washed with 50 ml of absolute ethanol and dried in vacuo at 50° C. to constant weight. 64 g (approximately 76% of theory) of a pale yellow crystalline powder with a melting point of 102° to 169° C. are obtained, and this can be identified by analysis as a mixture consisting of 89.5% of the compound of the formula

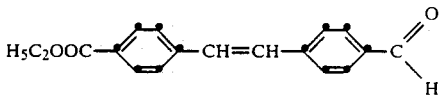

(901)

and 9.1% of the compound of the formula

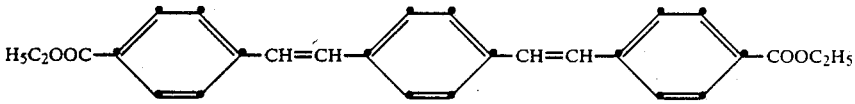

(902)

12 g of the phosphonate of the formula

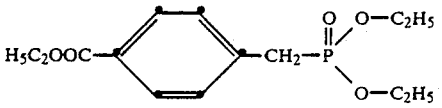

(801)

are suspended in 120 ml of dimethylformamide, and 22 ml of an ethanolic 2M solution of sodium ethylate are added in the course of 15 minutes at 30° C., with stirring and under nitrogen. The reaction mixture is worked up as described in Example 3. 13 g (approximately 86% of theory) of a yellow crystalline product with a melting point of 178° to 181° C. are obtained, and on analysis this proves to be a mixture consisting of 95.3% of the compound of the formula After recrystallising twice from ethanol, and with removal of the compound of the formula (902) which is insoluble in ethanol, 32 g of the aldehyde of the formula (901) are obtained in the form of long, pale yellow needles with a melting point of 103° to 105° C.

EXAMPLE 10

8 g of the mixture of the compounds (302) and (303), which has been obtained according to Example 3, and 9 g of the phosphonate of the formula (701) are reacted in 80 ml of dimethylformamide as described in Example 3. 10 g (approximately 78% of theory) of a pale yellow crystalline powder with a melting point of 228° to 236° C. are obtained, and on analysis this proves to be a mixture consisting of 93.4% of the compound of the formula

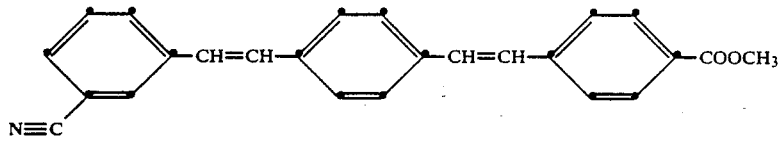

(1001)

and 5.5% of the compound of the formula (303).

EXAMPLE 11

9.3 g of the mixture of the compounds (302) and (303), which has been obtained according to Example 3, and 12 g of the phosphonate of the formula (801) are suspended in 120 ml of dimethylformamide, and 22 ml of an ethanolic 2M solution of sodium ethylate are added in the course of 15 minutes at 30° C., with stirring and under nitrogen. The reaction mixture is worked up as described in Example 3. 12.5 g (approximately 82% of theory) of a yellow crystalline product with a melting point of 194° to 197° C. are obtained, and on analysis this proves to be a mixture consisting of 92.6% of the compound of the formula

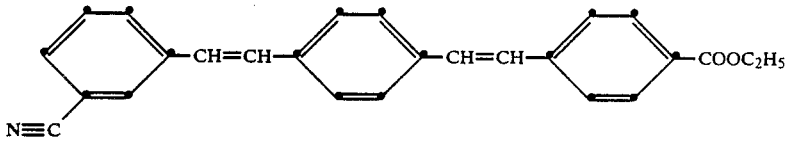

(1101)

and 6.5% of the compound of the formula (303).

EXAMPLE 12

11.7 g of the mixture of the compounds (17) and (6), which has been obtained according to Example 2, and 13 g of the phosphonate of the formula (701) are reacted in 100 ml of dimethylformamide as described in Example 3. 16 g (approximately 87% of theory) of a yellow crystalline powder with a melting point of 219° to 225° C. are obtained, and on analysis this proves to be a mixture consisting of 97.2% of the compound of the formula

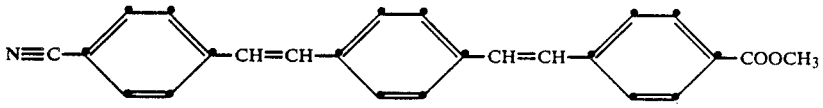

(1201)

and 2.6% of the compound of the formula (6).

EXAMPLE 13

9.3 g of the mixture of the compounds (17) and (6), which has been obtained according to Example 2, and 12 g of the phosphonate of the formula (801) are suspended in 120 ml of dimethylformamide, and 22 ml of an ethanolic 2M solution of sodium ethylate are added in the course of 15 minutes at 30° C., with stirring and under nitrogen. The reaction mixture is worked up as described in Example 3. 13.5 g (approximately 89% of theory) of a yellow crystalline powder with a melting point of 219° to 221° C. are obtained, and on analysis this proves to be a mixture consisting of 95.5% of the compound of the formula

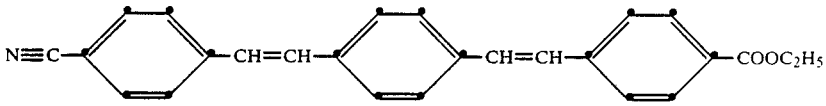

(1301)

and 3.4% of the compound of the formula (6).

EXAMPLE 14

18.6 g of the mixture of the compounds (17) and (6), which has been obtained according to Example 2, and 24 g of the phosphonate of the formula

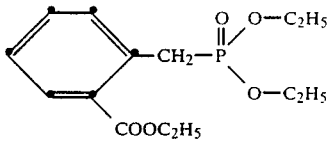

(1401)

are suspended in 60 ml of dimethylformamide, and 35 ml of an ethanolic 2.5M solution of sodium ethylate are added in the course of 15 minutes at 30° C., with stirring and under nitrogen. The reaction mixture is worked up as described in Example 3. 11.5 g (approximately 38% of theory) of a yellow crystalline powder with a melting point of 143° to 169° C. are obtained, and on analysis this proves to be a mixture consisting of 90.6% of the compound of the formula (1402)

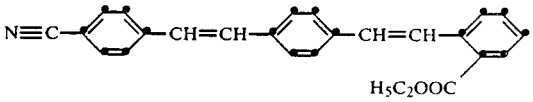

and 8.3% of the compound of the formula (6).

The phosphonate of the formula (1401), which is used as starting material, is prepared as follows:

55.2 g of sodium are initially introduced into 360 ml of toluene, and the toluene is heated to the reflux temperature. The molten sodium is finely powdered with the aid of a vibro mixer, with rapid cooling. First 5 ml of anhydrous ethanol and then 331 g of diethyl phosphite are now added dropwise in the course of one hour to the resulting suspension of sodium in toluene, at 60° C. and with vigorous mixing using the vibro mixer, and the sodium rapidly goes into solution. After a further hour at 60° C., the sodium has dissolved completely and a clear solution forms. 600 g of the compound of the formula

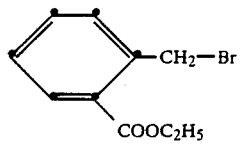

(1403)

are now added dropwise in the course of one hour to this solution of the sodium salt of the diethyl phosphite, at 60° C. with mixing with the vibro mixer, and sodium bromide precipitates out. The resulting suspension is mixed for 20 hours at 60° C. using the vibro mixer and is then cooled to room temperature, taken up in methylene chloride, washed with a 2N sodium carbonate solution and then with water until neutral, dried over sodium sulphate and concentrated to dryness in vacuo in a rotary evaporator. 696 g of a yellow-brown oil are obtained and after distillation this gives 503 g (70% of theory) of the phosphonate of the formula (1401) in the form of a yellow oil (boiling point$_{0.08}$: 158°-160° C.).

The ethyl 2-bromomethyl-benzoate of the formula (1403) is prepared in accordance with J. Chem. Soc. 121, 2202-2215 (1922).

EXAMPLE 15

19.6 g of the mixture of the compounds (901) and (902), which has been obtained according to Example 9, and 21 g of the phosphonate of the formula (1401) are suspended in 60 ml of dimethylformamide, and 31 ml of an ethanolic 2.5M solution of sodium ethylate are added in the course of 15 minutes at 30° C., with stirring and under nitrogen. The reaction mixture is worked up as described in Example 3. 11 g (approximately 37% of theory) of a pale yellow crystalline powder with a melting point of 125° to 250° C. is obtained, and on analysis this proves to be a mixture consisting of 87.5% of the compound of the formula

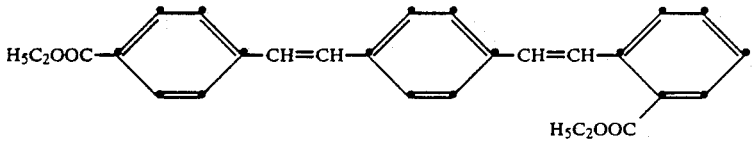

(1501)

and 12.1% of the compound of the formula (902).

EXAMPLE 16

19.6 g of the mixture of the compounds (901) and (902), which has been obtained according to Example 9, and 21 g of the phosphonate of the formula

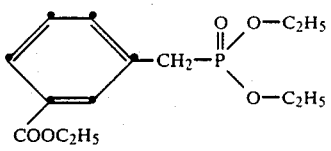

(1601)

are suspended in 50 ml of dimethylformamide, and 31 ml of an ethanolic 2.5M solution of sodium ethylate are added in the course of 15 minutes at 30° C., with stirring and under nitrogen. The reaction mixture is worked up as described in Example 3. 23 g (approximately 74% of theory) of a pale yellow crystalline powder with a melting point of 183° to 250° C. are obtained, and on analysis this proves to be a mixture consisting of 94.7% of the compound of the formula

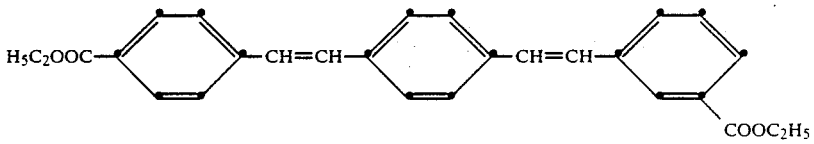

(1602)

and 5.4% of the compound of the formula (902).

The phosphonate of the formula (1601), which is used as starting material, is prepared analogously to Example 2 of British Patent Specification No. 929,436 and purified by distillation (boiling point$_{0.3}$: 183°-185° C.).

EXAMPLE 17

1 g of the fluorescent brightener consisting of 91.2% of the compound of the formula (3) and 7.7% of the compound of the formula (4) is dispersed in 1,000 ml of water. 100 ml of water containing 0.1 g of a fatty alcohol polyglycol ether are added to 7.5 ml of this dispersion. Polyester fabric weighing 15 g is put into this brightener dispersion, which has been warmed at 60° C. The temperature is raised to 120° C. in the course of 15 to 20 minutes, and this temperature is maintained for 30 minutes. The dispersion is then cooled to 60° C. in the course of 10 to 15 minutes. The fabric is then rinsed for 2 minutes in running cold water and is then dried for 20 minutes at 60° C.

The fabric treated in this way has a powerful white effect of good fastness to light.

Similarly good white effects are obtained when this procedure is repeated using a fluorescent brightener consisting of 95.7% of the compound of the formula (3) and 3.2% of the compound of the formula (6) or a fluorescent brightener consisting of 88.3% of the compound of the formula (304) and 10.9% of the compound of the formula (303) in place of the fluorescent brightener mentioned.

EXAMPLE 18

Polyester fabric is padded at room temperature with an aqueous dispersion which contains, per liter, 0.5 g of a fluorescent brightening agent consisting of 91.2% of the compound of the formula (3) and 7.7% of the compound of the formula (4) and also 1 g of an adduct of about 8 mols of ethylene oxide and 1 mol of p-tert.-octylphenol. The liquor pick-up is 60 to 70%. The fabric is dried at 100° C. and is then heated to 180° C. for 15 seconds.

The fabric treated in this way has a powerful white effect of good fastness to light.

Similarly good white effects are obtained when this procedure is repeated using a fluorescent brightening agent consisting of 95.7% of the compound of the formula (3) and 3.2% of the compound of the formula (6) or a fluorescent brightening agent consisting of 88.3% of the compound of the formula (304) and 10.9% of the compound of the formula (303) in place of the fluorescent brightening agent mentioned.

Similar white effects are achieved by the two procedures of Examples 17 and 18 when the fluorescent brightening agent used is a two-component fluorescent brightener consisting of 95.7% of the compound of the formula (304) and 3.8% of the compound of the formula (6); 85.1% of the compound of the formula (501) and 13.8% of the compound of the formula (303); 91.6% of the compound of the formula (501) and 7.1% of the compound of the formula (4); 93.3% of the compound of the formula (702) and 5.6% of the compound of the formula (4); 95.3% of the compound of the formula (802) and 3.9% of the compound of the formula (4); 93.4% of the compound of the formula (1001) and 5.5% of the compound of the formula (303); 92.6% of the compound of the formula (1101) and 6.5% of the compound of the formula (303); 97.2% of the compound of the formula (1201) and 2.6% of the compound of the formula (6); 95.5% of the compound of the formula (1301) and 3.4% of the compound of the formula (6); 90.6% of the compound of the formula (1402) and 8.3% of the compound of the formula (6); 87.5% of the compound of the formula (1501) and 12.1% of the compound of the formula (902); or 94.7% of the compound of the formula (1602) and 5.4% of the compound of the formula (902).

EXAMPLE 19

1 g of the fluorescent brightener consisting of 91.2% of the compound of the formula (3) and 7.7% of the compound of the formula (4) is dispersed in 1,000 ml of water. 100 ml of water containing 0.06 g of an alkylpolyglycol ether are added to 3 ml of this dispersion. Polyamide fabric (polyamide 6 or 66) weighing 3 g is put into this brightener dispersion, which has been warmed to 60° C. The temperature is raised to 95° to 97° C. in the course of 10 to 15 minutes and this temperature is maintained for 30 minutes. The fabric is then rinsed for 2 minutes in running cold water and is then dried for 20 minutes at 60° C.

The fabric obtained in this way has a powerful white effect of good fastness to light.

Similarly good white effects are obtained when this procedure is repeated using a fluorescent brightening agent consisting of 95.7% of the compound of the formula (3) and 3.2% of the compound of the formula (6) or a fluorescent brightening agent consisting of 88.3% of the compound of the formula (304) and 10.9% of the compound of the formula (303) in place of the fluorescent brightening agent mentioned.

EXAMPLE 20

A bath is prepared which contains, per liter of soft water, 0.0125, 0.025 or 0.05% by weight, based on the polyester material to be brightened, of a fluorescent brightener mixture consisting of a fluorescent brightener comprising 95.7% of the compound of the formula (3) and 3.2% of the compound of the formula (6) and a fluorescent brightener of the formula

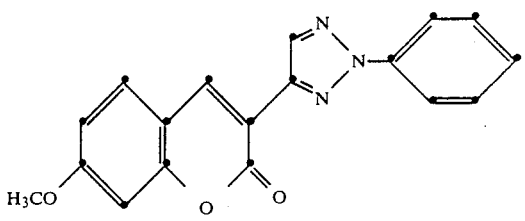

(2001)

in a mixing ratio of 1:2 or 2:1, and also 1 g of a fatty alcohol polyglycol ether.

Using a liquor ratio of 1:20, a polyester fabric ("Terylene Type 540") is put, at 40° C., into the bath, which is in a conventional HT dyeing apparatus. The bath is warmed to 110°, 120° or 130° C. in the course of 30 minutes and is kept at the particular temperature for 30 minutes. It is then cooled to 40° C. in the course of 15 minutes. The treated fabric is rinsed for 30 seconds in running, softened water and then dried.

The pieces of fabric treated have powerful, brilliant white effects with a pleasing shade. The greenish-bluish shade obtained when fluorescent brightening is carried out using the fluorescent brightener consisting of the compounds (3) and (6) on its own has been shifted distinctly into the more reddish range.

EXAMPLE 21

Polyester fabric ("Terylene Type 540") is padded at room temperature with an aqueous dispersion which contains, per liter, 0.125, 0.25, 0.5 or 1 g of a fluorescent brightener mixture consisting of a fluorescent brightener comprising 95.7% of the compound of the formula (3) and 3.2% of the compound of the formula (6) and a fluorescent brightener of the formula (2001) in a mixing ratio of 1:2 or 2:1, and also 1 ml of an alkylphenol polyglycol ether. The liquor pick-up is 80%. The fabric is dried at 80° C. for 10 minutes and is then thermofixed for 30 seconds at 180°, 200° or 220° C.

The pieces of fabric treated have powerful, brilliant white effects with a pleasing shade. The greenish-bluish shade obtained when fluorescent brightening is carried out using the fluorescent brightener consisting of the compounds (3) and (6) on its own has been shifted distinctly into the more reddish range.

EXAMPLE 22

Example 20 or 21 is repeated, except that, in place of the fluorescent brightener of the formula (2001), the same amount of one of the fluorescent brighteners of the formulae (2201)
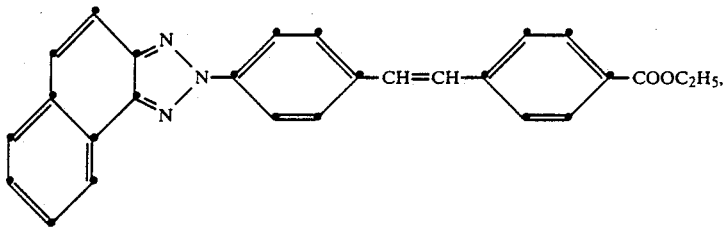
(2202)
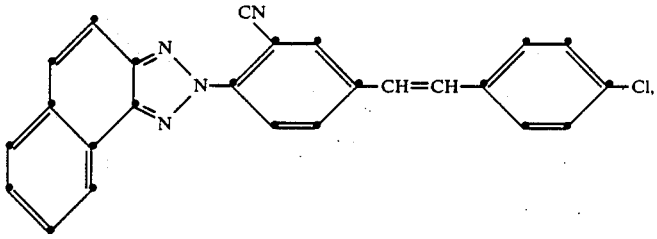
(2203)
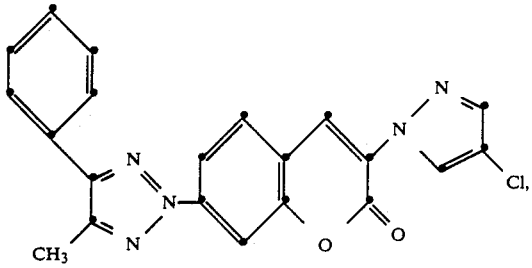
(2004)
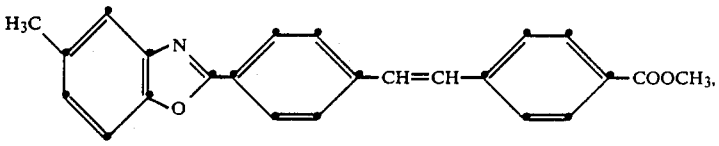
(2205)
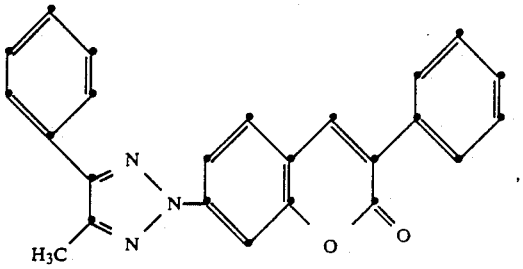
(2206)
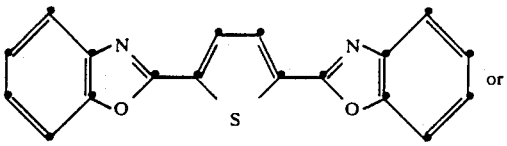

-continued (2207)

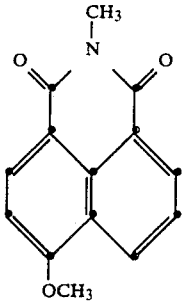

is employed. Good effects, similar to those described in Examples 20 and 21, are obtained on the pieces of fabric treated.

The fluorescent brightener consisting of the compounds (3) and (6) can also be replaced by any other desired two-component fluorescent brightening agent obtainable according to Examples 1, 3–8 and 10–16.

What is claimed is:

1. A process for the preparation of a stilbene-aldehyde of the formula

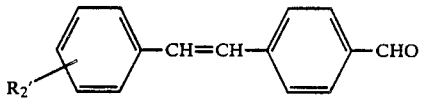

in which $R_2'$ is cyano or a carboxylic acid ester group of the formula —COOY, in which Y is alkyl, halogenoalkyl, aralkyl, carbalkoxyalkyl, cyanoalkyl, hydroxyalkyl, aminoalkyl, alkylaminoalkyl or dialkylaminoalkyl, and all of the abovementioned alkyl groups and alkyl moieties in composite groups have 1 to 6 carbon atoms in each case; or Y is alkenyl having 3 to 6 carbon atoms, cycloalkyl having 5 to 6 carbon atoms, propargyl, tetrahydrofurfuryl or a group of the formula $(CH_2—CH(X—)—O)_n$-alkyl, in which X is hydrogen or methyl and n is an integer between 1 and 4 and the alkyl group has 1 to 6 carbon atoms, which comprises adding a compound of the formula

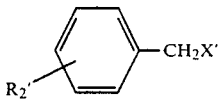

in which X' is a radical of the formula

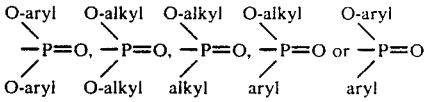

to a solution containing terephthaldehyde to form a reaction product which precipitates from the solution and which contains the stilbene-aldehyde in a purity of at least 80% and separating off the desired stilbene-aldehyde from the reaction product by at least one recrystallization or by chromatography.

* * * * *